US011262156B2

(12) United States Patent
Caudle et al.

(10) Patent No.: US 11,262,156 B2
(45) Date of Patent: Mar. 1, 2022

(54) AIR GUN FOR CONVENTIONAL METAL-JACKET BULLETS

(71) Applicants: Carl E Caudle, Moses Lake, WA (US); Nathanel J Caudle, Moses Lake, WA (US); Nakkii White, Darlton Gardens, ID (US)

(72) Inventors: Carl E Caudle, Moses Lake, WA (US); Nathanel J Caudle, Moses Lake, WA (US); Nakkii White, Darlton Gardens, ID (US)

( * ) Notice: Subject to any disclaimer, the term of this patent is extended or adjusted under 35 U.S.C. 154(b) by 0 days.

(21) Appl. No.: 16/908,522

(22) Filed: Jun. 22, 2020

(65) Prior Publication Data

US 2021/0231403 A1 Jul. 29, 2021

Related U.S. Application Data

(60) Provisional application No. 62/862,162, filed on Jun. 17, 2019.

(51) Int. Cl.

| | |
|---|---|
| ***F41A 21/18*** | (2006.01) |
| ***F41B 11/62*** | (2013.01) |
| ***F42B 6/10*** | (2006.01) |

(52) U.S. Cl.

CPC ..... *F41B 11/62* (2013.01); *F42B 6/10* (2013.01)

(58) Field of Classification Search

CPC ..... F42B 6/10; F41A 21/18; F41A 21/16

See application file for complete search history.

(56) References Cited

U.S. PATENT DOCUMENTS

| | | | | | |
|---|---|---|---|---|---|
| 119,846 | A * | 10/1871 | Henry | F41A 21/18 | 42/78 |
| 587,801 | A * | 8/1897 | Durnford | F41A 21/18 | 42/78 |
| 2,872,846 | A * | 2/1959 | Crozier | F41A 1/00 | 89/7 |
| 2,982,550 | A * | 5/1961 | Francis | F42B 6/10 | 473/569 |
| 3,111,121 | A * | 11/1963 | Baggott | F41B 11/642 | 124/67 |
| 3,345,949 | A * | 10/1967 | Nosler | F42B 14/02 | 102/516 |
| 3,673,916 | A * | 7/1972 | Wittholz | F41A 21/18 | 89/1.816 |
| 3,780,465 | A * | 12/1973 | Polcha | F41A 21/20 | 148/565 |
| 4,697,523 | A * | 10/1987 | Saxby | F42B 6/10 | 102/440 |
| 5,078,117 | A * | 1/1992 | Cover | F41B 11/57 | 124/71 |
| 5,196,637 | A * | 3/1993 | Petrovich | F41A 21/04 | 42/76.02 |
| 5,700,972 | A * | 12/1997 | Saxby | F41B 11/62 | 102/440 |
| 6,619,278 | B1 * | 9/2003 | Lin | F41B 11/62 | 102/440 |

(Continued)

*Primary Examiner* — Derrick R Morgan

(57) ABSTRACT

Air guns and non-firearm guns for conventional metal jacket bullets are provided. Novel chamber and throat geometries, novel barrel rifling schemes, barrel materials, and surface technology facilitate manufacture or retrofit of air guns and other non-firearm guns to use standard size metal jacket bullets manufactured for conventional firearms.

18 Claims, 8 Drawing Sheets

(56) References Cited

U.S. PATENT DOCUMENTS 7,197,986 B1 * 4/2007 Calkins ..... F41A 21/22 102/435
7,337,774 B2 * 3/2008 Webb ..... F41B 11/71 124/60
7,412,975 B2 * 8/2008 Dillon, Jr. ..... F41B 11/62 102/440
7,954,413 B2 * 6/2011 Koth ..... F41B 11/681 89/7
8,191,480 B2 * 6/2012 Mcaninch ..... F41B 11/00 102/447
8,291,632 B2 * 10/2012 Taylor ..... B21J 5/12 42/76.1
8,322,329 B1 * 12/2012 Sikes ..... F41B 11/723 124/73
8,393,273 B2 * 3/2013 Weeks ..... F42B 12/74 102/506
9,046,333 B2 * 6/2015 Masinelli ..... F42B 12/78
9,068,789 B2 * 6/2015 Glock ..... F41A 21/18
9,234,716 B2 * 1/2016 Feddersen ..... F41A 21/18
9,404,719 B1 * 8/2016 Bowers ..... F42B 5/025
9,631,890 B2 * 4/2017 Tseng ..... F41B 11/724
10,119,780 B1 * 11/2018 Bergeron ..... F42B 12/74
10,782,107 B1 * 9/2020 Dindl ..... F41A 15/12
10,883,785 B1 * 1/2021 Rophael ..... F41A 21/18
10,890,399 B2 * 1/2021 Gardner, Jr. ..... F41A 21/18
11,009,313 B2 * 5/2021 DiBlasio ..... F16K 31/44
2004/0031382 A1 * 2/2004 Ogram ..... F41B 11/57 89/7
2006/0180134 A1 * 8/2006 Lluzzi ..... F41B 11/54 124/74
2012/0180772 A1 * 7/2012 St. Phillips ..... F41B 11/62 124/73
2015/0013656 A1 * 1/2015 Priestley ..... F42B 6/10 124/74
2015/0316345 A1 * 11/2015 Brahler, II ..... F41B 11/723 124/73
2016/0209146 A1 * 7/2016 Smith ..... F41A 21/18
2020/0003514 A1 * 1/2020 Gardner, Jr. ..... F41A 21/18

* cited by examiner

EXAMPLE .22 CALIBER DIMENSIONS – PRIOR ART

EXAMPLE .22 CALIBER DIMENSIONS – NOVEL AIR GUN

AIR GUN FOR CONVENTIONAL METAL-JACKET BULLETS

PRIORITY CLAIM AND CROSS-REFERENCE TO RELATED APPLICATION

This application claims the benefit under 35 U.S.C. § 119(e)(1) of U.S. Provisional Application No. 62/862,162, filed Jun. 17, 2019, which is hereby incorporated by reference in its entirety.

BACKGROUND

An air gun is a type of gun that launches projectiles pneumatically with compressed air or other compressed gases (air is already a mixture of various gases), with the gases at ambient temperatures. Such "non-firearm" guns can come in several varieties, such as pump air guns, $CO_2$ cartridge air guns, and PCP (Pre-Charged Pneumatics) air guns, which utilize a reservoir or "tank" of compressed air or gases. A PCP air gun may be an unregulated mechanical PCP, a regulated mechanical PCP, or an electronic PCP.

A conventional firearm, by contrast, generates pressurized combustion gases chemically through exothermic oxidation of combustible propellants, such as gunpowder, which generate propulsive energy by breaking molecular bonds in an explosive production of high temperature gases. In modern firearms, the combustion gases are generally formed within a cartridge comprising the projectile inserted into a casing containing the fuel. This propulsive energy is used to launch the projectile from the casing, and thus from the firearm.

Other differences between air guns and conventional firearms can be observed as differences in pressures inside the respective barrels, muzzle energies, projectile speeds, and projectile weights that can be shot, for example. A conventional rifle chambered for a .22 long rifle (LR) cartridge fires a 40-grain bullet at approximately 1200 ft/sec. A powerful air rifle may fire a 14.3 grain pellet with a muzzle velocity of approximately 900 ft/sec. The conventional firearm generates a muzzle energy of approximately 130 ft-lbs of energy at the muzzle whereas that of the air rifle generates only about 26 ft-lbs.

The compressed gas or air of air guns currently achieves maximum pressures of 4500-5000 psi, but these high pressures are not currently in common use. On the other hand, by comparison, the lowest pressure rifle cartridges may be black powder cartridges of yesteryear and certain rimfire cartridges. Some of these lesser firearm cartridges still generate barrel pressures of 15,000-20,000 psi, or 20,000-25,000 psi for rimfire, which is a much higher pressure level than air guns can currently achieve.

Therefore, the conventional high power air rifle is still "handicapped" in comparison to conventional firearms by low operating pressure of ⅕ that of a firearm, or lower, which is its primary limitation when being compared with firearms. This limitation can restrict the type and size of projectile that an air gun can launch, based on the mass of the projectile and the limited available energy of the air gun.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1:
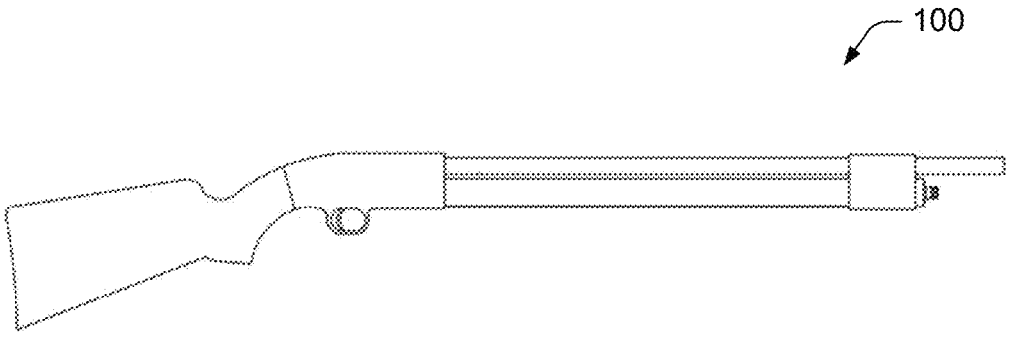
FIG. 1 is an illustration of an example air gun, according to an embodiment.

Referring to FIG. 1, this disclosure describes air guns 100 for shooting conventional metal jacket bullets, according to several embodiments. Various novel features are described, which configure an air gun 100 to shoot stock metal-jacket bullets 302 that have been made for firearms (see FIG. 3, for example). In some embodiments, an air gun 100 is capable of shooting a conventional solid metal bullet, metal alloy bullet, metal jacketed bullet, or metal composite bullet (all referred to herein as "metal jacket bullets 302" for convenience) designed and manufactured for firearms, at a velocity of 500 feet per second or greater. To adapt the air gun to use metal jacketed bullets 302 manufactured for firearms, the barrel has novel sectional rifling that makes the use of metal jacket bullets possible. Both the barrel and its rifling provide the lowest obtainable coefficient of friction and deformation characteristics in order for the metal jacket bullets to work in an air gun application. In an implementation, the amount of the barrel surface area touching the metal-jacket bullet at any one time during its traverse down the bore of the barrel is minimized in order to reduce friction.

The features described herein apply to "non-firearm" guns, such as pump air guns, guns that rely on a CO2 cartridge, PCP (Pre-Charged Pneumatics) air guns, which utilize a reservoir or "tank" of compressed air or gases, spring guns, magnetic guns, and so forth, without creating additional pressure through chemical reactions that change the chemical nature of the propellant during "firing" of the air gun. The pressurized gases may be pressurized mechanically on or off the air gun, or they may have been pressurized beforehand and stored in a removable canister.

Figure 2:
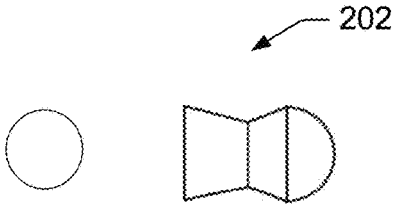
PRIOR ART FIG. 2
FIG. 2 shows two examples of typical air gun ammunition.

Standard metal jacket bullets are conventionally considered too heavy for air guns, too abrasive on inner surfaces, prone to friction, and too slow for conventional air guns. The lack of relative power of air guns is compensated for by using very lightweight projectiles to get desired projectile velocities. Thus, conventional air guns generally use alternative ammunition, as shown at FIG. 2. As shown, air gun ammunition 202 generally consists of light-weight spherical shot or diablo-shaped pellets (wasp-waist shaped) that are light enough to be launched by the compressed gases of the air gun. For example, .177 pellets for air guns weigh approximately 7 grains compared to .172 rifle bullets that weigh from around 18 to 25 grains. In another example, .22 pellets for air guns weigh approximately 12 grains compared to 35 to 55 grains for conventional .22 bullets and up to 80 grains for long range (LR) match conventional .22 bullets for firearms.

Air gun diablo-shaped pellets 202 may be considered modified shot. They usually comprise a soft metal pellet with an attached skirt to reduce blow-by when they are fired and that may that assist with stabilization during flight. Some conventional air guns may also shoot BBs, darts, or arrows. Based on the shape of the typical air gun ammunition 202 and the lower energy of the compressed air, many air guns have a limited range and application. For instance, conventional air guns using ammunition 202 such as shot or diablo-shaped pellets may not be effective for hunting at desired distances.

Figure 3:
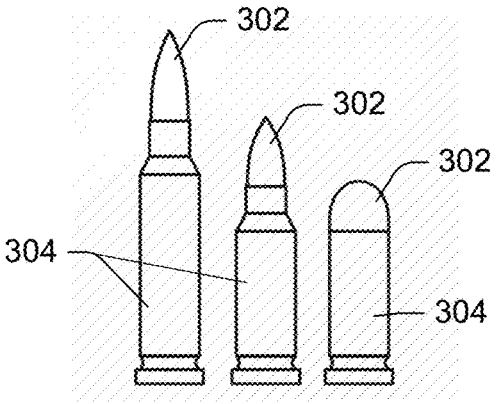
FIG. 3 shows three examples of typical firearm ammunition.

However, example air guns 100 described herein are capable of propelling conventional metal jacket bullets 302 (for example, as shown at FIG. 3) that come in standard sizes for firearms, pneumatically by compressed air (for example), instead of by cartridge and gunpowder as in conventional firearms. Stock bullet sizes for firearms that may be used with the air gun 100 include all standard and non-standard calibers between .172 and .84. For instance, the .22 Long Rifle (LR), .22 Long, .22 Short, .30 carbine, .30-06 (and all .30 caliber variations), .380, .38 Special, .357 magnum, 9 mm, .40 SW, 10 mm, .45 ACP, .452, .456, .458, .459, .50, .501, .510, .72 caliber (12 gauge slug), .84 caliber (20 mm), 5.7×28 mm, 5.56×45 mm NATO, and all others. Some example bullet 302 calibers are given for discussion purposes, however failure to list a specific caliber is not intended to exclude that bullet 302 caliber. Example air guns 100 described herein are configured to shoot all known calibers world-wide, including all standard firearm bullet 302 sizes, as defined by the Sporting Arms and Ammunition Manufacturers Institute, Inc. (SAAMI) and in conjunction with the American National Standards Institute (ANSI) (See SAAMI Z229.1-Rimfire-2015 (R2018), SAAMI Z229.3-Centerfire Pistol & Revolver-2015, and SAAMI Z229.4-Centerfire Rifle-2015).

The example air guns 100 enable conventional metal jacket bullets 302 to be pneumatically propelled ("shot") from an air gun 100 without the cartridge case 304 containing gunpowder that would be present if the metal jacket bullet 302 were to be used as a round, cartridge, or ammunition in a conventional firearm. The various inventions can be used in manufacturing new air guns 100, and in retrofitting existing air guns.

Although some of the example air guns 100 described herein use reservoirs or tanks of compressed air to propel the metal-jacket bullets, these are described as representative examples for all types of "air guns" 100 that may be modified as described herein to shoot metal jacket bullets 302, including air guns 100 that use air, gas, or combinations of multiple gases (air is already a combination of gases), liquids with transitional state chemicals, magnetics, or other propulsion methods that do not use a conventional cartridge case 304 with ignition of gunpowder.

Figure 4:
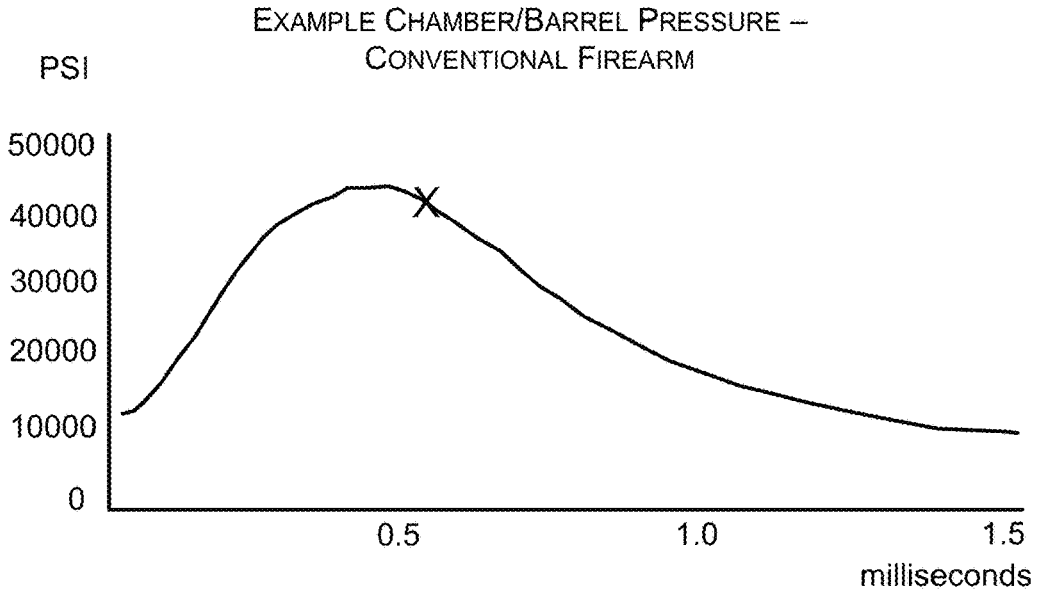
FIG. 4 shows an example diagram of chamber/barrel pressure in a conventional firearm over time.

FIG. 4 illustrates an example curve showing the chamber/barrel pressure of a conventional firearm with respect to time, as the firearm is triggered. The example pressure curve of FIG. 4 is shown for discussion purposes, and is not intended to represent all firearms. In firearms, much gas pressure (e.g., often as much as 65,000 psi, and upwards of 80,000 psi in some cases) is generated from burning gunpowder by conversion of solids (carbon and sulfur) to gas, combined with heat expansion during the ignition and combustion processes. Heat is generated by the chemical reaction (e.g., around 4000° F.) that raises the temperature of many components of the firearm, and that can cause the barrel to reach very high temperatures (e.g., around 700°-900° F. at the end of the barrel in some cases) for a short time, depending on the frequency of subsequent ignition events. Accordingly, the pressure curve for a conventional firearm is characterized by expanding gases and high heat, which provide the energy for propelling a bullet from the firearm. The higher pressures of conventional firearms cause higher forces, which cause higher bullet accelerations (e.g., 2700 to 2800 ft./sec. and upwards of 3100 ft./sec. in some cases).

Referring to FIG. 4, when the firearm is triggered (shown at time zero) the pressure within the chamber rises significantly, almost instantaneously, as the solid fuel is ignited. Pressure (and heat) within the chamber and barrel builds as the burning fuels increase the gases within, and as those gases expand with the heat. The bullet is expelled from the barrel of the firearm at a point near the peak pressure (as indicated by the "X" on the diagram). The gases continue to expand, however the pressure can drop within the barrel as the end of the barrel opens to free the gases when the bullet leaves. In many cases, the still-burning fuel continues to produce heated gases after the bullet is expelled, which can result in a "muzzle flash" at the end of the barrel.

Figure 5:
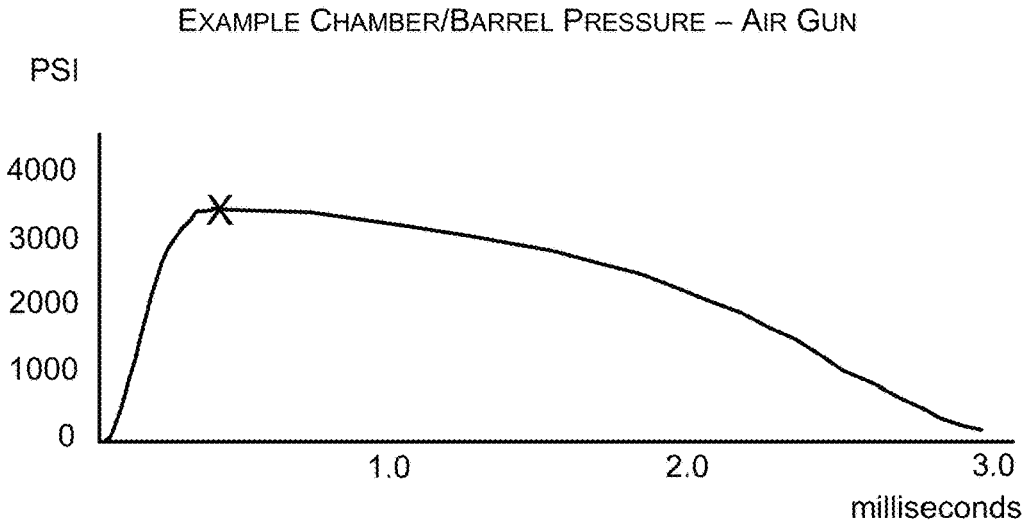
FIG. 5 shows an example diagram of chamber/barrel pressure in an air gun over time.

Conventional air rifles, on the other hand, involve no chemical change of state and no burning or heat. FIG. 5 illustrates an example curve showing the chamber/barrel pressure of a conventional air gun with respect to time, as the air gun is triggered. The example pressure curve of FIG. 5 is shown for discussion purposes, and is not intended to represent all air guns.

The one or more propellant gases of an air gun go from high pressure to a lower pressure when propelling a projectile, but the one or more gases remain the same gases chemically. Significantly, the current pressure level in the reservoir or gas source of an air gun before a projectile is shot by the air gun (which can be upwards of 3500 psi in some cases) represents the maximum pressure that can be achieved behind a projectile in a conventional air gun, because there is no explosive combustion of gunpowder to create additional pressure (no expanding gases). Accordingly, the pressure curve for a conventional air gun is characterized by diminishing gases and low or no heat, which provide the energy for propelling a projectile from the air gun. The initial lower pressures of air guns and the diminishing pressure characteristic cause lower forces, which cause more limited bullet accelerations.

Referring to FIG. 5, when the air gun is triggered (shown at time zero) the pressure within the chamber rises as stored compressed gases are introduced into the chamber (e.g., through a valve). Projectile acceleration starts at zero as the compressed gas enters the chamber of the air gun until there is enough breech pressure for the projectile to move. Pressure within the chamber quickly builds to match the gas pressure of the compressed gas storage container (which may be onboard or remote from the air gun). The projectile is expelled from the barrel of the air gun at a point at or near the peak pressure (as indicated by the "X" on the diagram). The pressure of the gases within the chamber/barrel diminishes as the projectile travels down the barrel, since the volume the gas occupies increases. With the increase of volume, the gas cools as it loses energy and pressure, finally dropping to ambient pressure as the projectile leaves the end of the barrel. Accordingly, except for some heat generated from friction as the projectile travels through the barrel, the barrel does not tend to heat up, even with subsequent triggering events.

Figure 6:
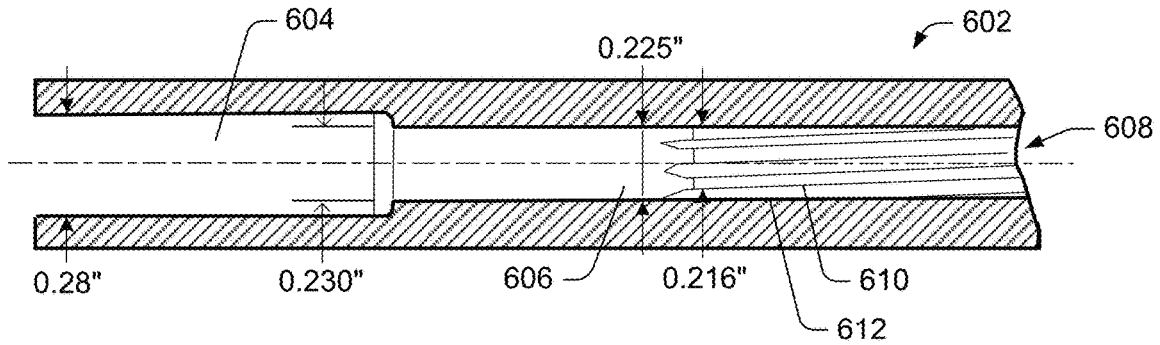
FIG. 6 shows a cross-section of a portion of an example .22 caliber firearm chamber and barrel.
Figure 7:
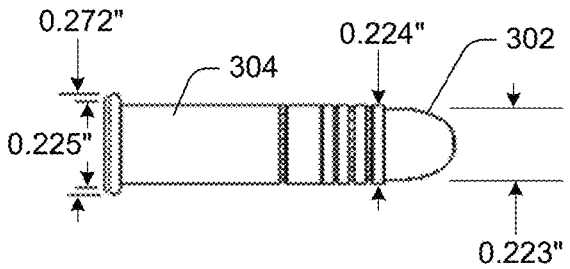
FIG. 7 shows a side view of an example .22 caliber cartridge.
Figure 8:
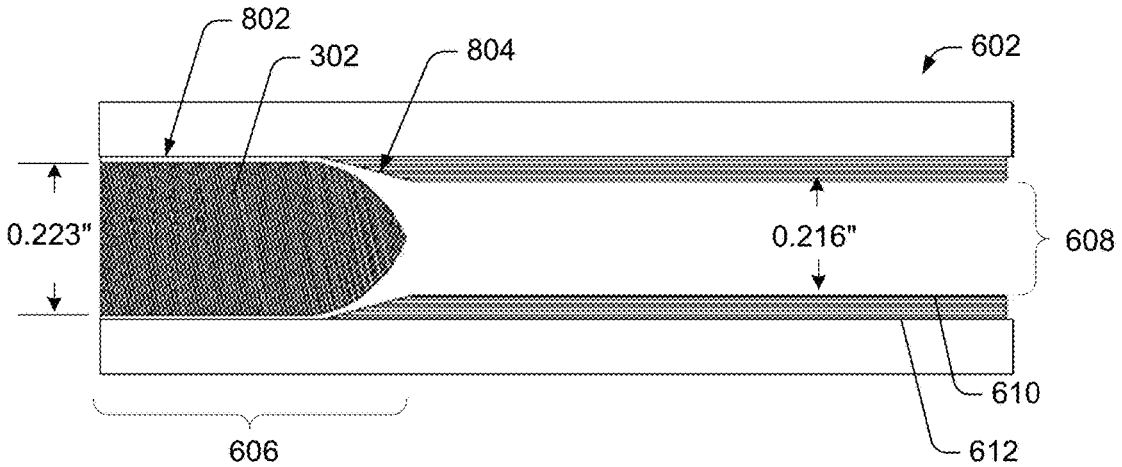
FIG. 8 shows a cross-sectional diagram of a chambered bullet in an example .22 caliber firearm.

FIG. 6 shows a cross-section of a portion of an example .22 caliber firearm barrel 602, including the chamber 604, throat 606, and bore 608. FIG. 7 shows the dimensions of a typical .22 cartridge, and FIG. 8 shows a detail view of the bullet 302 within the throat 606 at the entrance to the bore 608. Referring to FIGS. 6, 7, and 8, the dimensions of the bullet 302 (at FIG. 7) can be compared to the dimensions of the chamber 604, throat 606, and bore 608 (at FIGS. 6 and 8). While .22 caliber dimensions are shown, the discussion is also relevant to firearms of other calibers and their respective ammunition, with their associated dimensions.

The chamber 604 is the first portion of the barrel 602, and it has an interior diameter that is sized larger than the outer diameter of the bullet 302 for easy loading of the bullet 302. The throat 606 is the section of the barrel 602 that accommodates the bullet 302, and has an interior dimension (e.g., 0.225") just over the outer dimension of the bullet 302 (e.g., 0.223"). The bore 608 is the travel path for the bullet 302 down the length of the barrel 602, and includes the rifling lands 610 and grooves 612. The rifling lands 610 and grooves 612 are disposed down the length of the barrel 602 in a helical arrangement, in order to induce a spin on the bullet 302 as it travels down the length of the barrel 608. While the dimension from groove 612 to groove 612 (e.g., 0.225") is just larger than the outer dimension of the bullet 302 (e.g., 0.223"), the bore 608 comprises the inside diameter of the lands 610, and has an inside dimension (e.g., 0.216") that is smaller than the outer dimension of the bullet 302 (e.g., 0.223").

Referring to the detail of FIG. 8, the throat 606 is comprised of the freebore 802 and the leade 804. The freebore 802 has the greater dimension of the throat 606 (e.g., 0.225"). As shown at FIG. 8, the leade 804 is a tapered section of the throat 606 that transitions from the diameter of the freebore 802 (e.g., 0.225") to the smaller dimension of the bore 608 (e.g., 0.216"). In many cases, the leade 804 comprises a taper on the initial portion of the rifling lands 610.

During a triggering event, the extreme forces resulting from the combustion process (e.g., about 50,000 to 65,000 psi) deforms the bullet 302, first by compressing the bullet 302 against the leade 804 and the rifling lands 610, and then by expanding the bullet 302 into the grooves 612 and pushing the bullet 302 into the bore 608. In the process, the lands 610 dig into the surface of the bullet 302 as the bullet is propelled down the bore 608.

Figure 9:
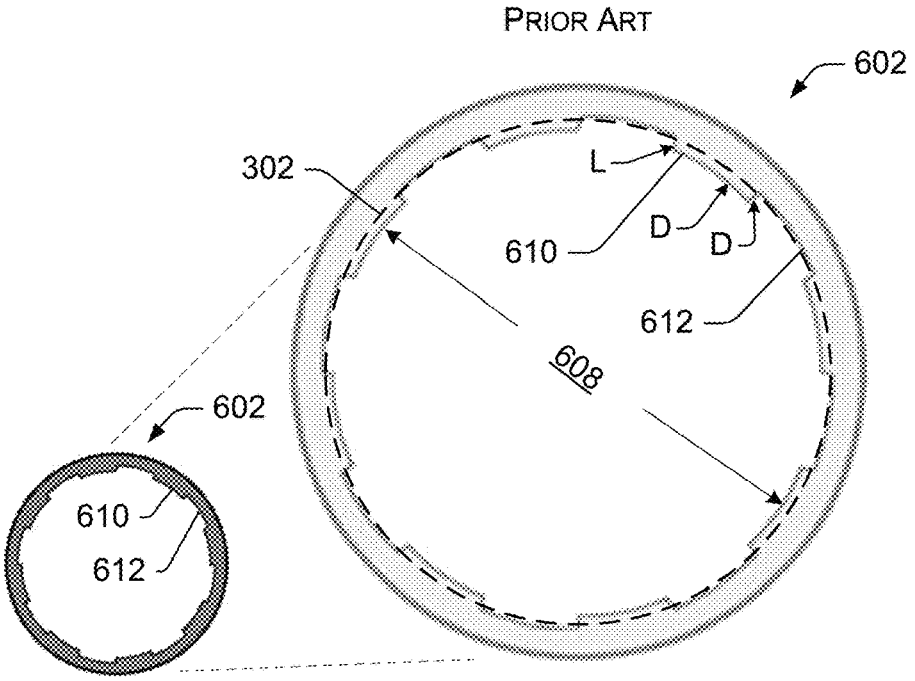
FIG. 9 shows an end view of a common rifling pattern for a firearm.
Figure 10:
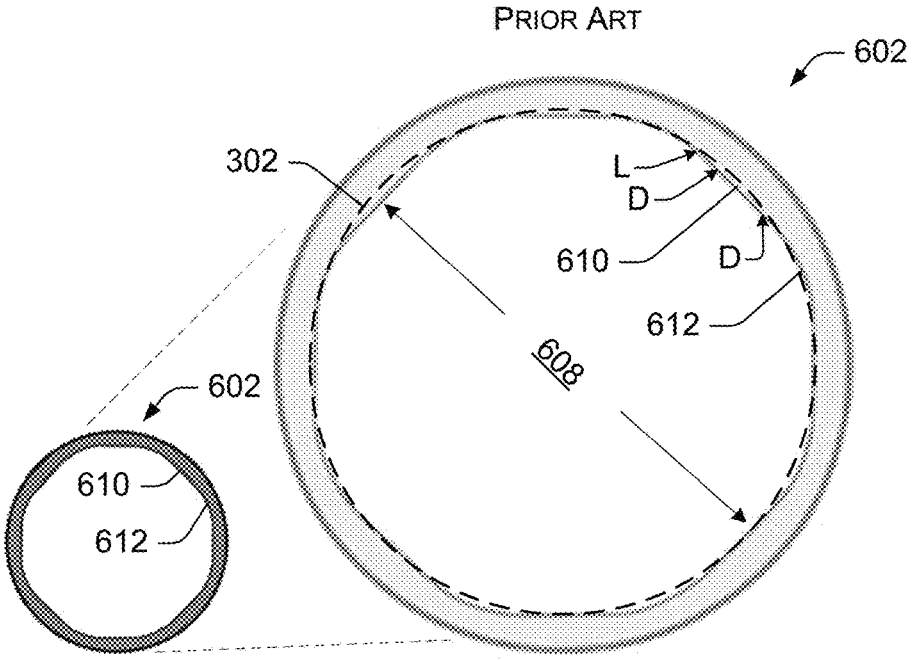
FIG. 10 shows an end view of another rifling pattern for a firearm.

FIGS. 9 and 10 show two examples of end views of the barrel 602, and include example section views of the lands 610 and grooves 612 of the rifling. Two common types of rifling are shown: an Enfield-style rifling at FIG. 9 and a polygonal-style rifling at FIG. 10. The rifling shape of each is generally consistent and rotates around the perimeter of the bore 608 for the length of the barrel 602, in a helix or screw arrangement, with the lands 610 and grooves 612 like the threads of a screw. The rate of rotation per length of barrel 602 (e.g., pitch) determines the speed of the spin on the bullet 302. The principle of these two rifling examples, as well as a myriad of other similar rifling types with lands 610 and grooves 612, is comparable. The goal is to seal the bore 608 (to reduce blow-by) and to induce a spin on the bullet 302.

FIGS. 9 and 10 also show an overlay of an example bullet 302 as it sits in the bore 608 while it moves down the barrel 602. The outer diameter of the bullet 302 fits within the grooves 612 of the rifling, while the lands 610 bite into the surface of the bullet 302. In many cases, the height of the lands 610 relative to the grooves 612 can be between 0.005" and 0.012". Accordingly, the bullet 302 is deformed and engraved as it is forcefully pushed into the rifling by the expanding combustion gases. (This is only possible with the greater forces generated by firearms, from the expanding gases of combustion—it is not possible with the lower pressures of air guns.) Further, material is generally removed from the bullet 302 during engraving and can be deposited in the rifling due to the lands 610 cutting into the surface of the bullet 302. This can necessitate frequent cleaning of the barrel 602 to prevent unsafe high pressures from occurring from narrowing the dimensions of the bore 608. This material depositing effect can be greater for softer bullet materials, such as lead, for example.

Since the rifling (i.e., the lands 610 and grooves 612) spirals down the length of the barrel 602 and the lands 610 and grooves 612 bite into and hold the bullet 302, the rifling induces a spin on the bullet 302 along a central longitudinal axis of the bullet 302 when the bullet 302 travels the length of the barrel 602. The spin can give stability to the bullet 302 during its flight, due to the gyroscopic effect of the spin. However, the sudden forceful pushing of the bullet 302 onto the lands 610 and grooves 612 can cause the bullet 302 to be slightly off of center when it travels down the bore 608. Spinning on an axis that is off from the central longitudinal axis of the bullet 302 induces the bullet 302 to wobble, resulting in a less stable flight. Further, the lands 610 can remove material from the bullet 302 unequally, relative to the central longitudinal axis during engraving. This can cause the mass of the bullet 302 to be unequal relative to the central longitudinal axis, creating a center of gravity that is off the central longitudinal axis, and also inducing a yaw wobble on the spinning bullet 302. The result is a loss in accuracy and a loss in flight range.

Referring to FIGS. 9 and 10, the leading edge of the lands 610 (indicated as "L" on the diagrams) guides and pulls the bullet 302 to induce the spin on the bullet 302. The other surfaces of the lands 610, including the trailing edge and the facing surface of the lands 610 (indicated as "D" on the diagrams) are potential drag surfaces. The drag surfaces can add friction which can slow the bullet 302, add heat to the bullet 302 and to the barrel 602, and add wear to the bore 608, as well as remove material from the bullet 302. In each case, the efficiency of the shot can be diminished and the wear on the firearm can be increased.

Example Novel Air Gun

In various implementations, novel chamber 604 geometry, barrel 602 rifling, and bore 608 surface technology described herein facilitate the ability of novel air guns 100 to use conventional metal jacket bullets 302 (as described above), which are usually deemed too heavy for air guns, too abrasive and hard on inner barrel 602 surfaces of air guns, too prone to friction to be used in air guns, and thus overall, too slow for use in conventional unmodified air guns—even without addressing the basic issue that the bore 608 dimension of a given air gun has to be manufactured to the diameter of the metal jacket bullet 302 to be used in the particular air gun.

In the implementations, to use standard metal jacket bullets 302 from common commercial sources, an example air gun 100 provides chamber 604, throat 606, bore 608, and barrel 602 features suitable for adapting the conventional metal jacket bullets 302 of firearms, to air gun use, wherein the metal jacket bullets 302 have a mass and a shape designed for the much higher pressures and temperatures of conventional firearms that use combusting gunpowder as the propellant instead of compressed gases.

In a conventional air gun, the behavior of the compressed gas in the chamber 604 and barrel 602 behind the projectile impacts how the projectile is propelled. For example, the mass, volume, and initial pressure of the compressed gas versus the mass and surface area of the projectile that the gas can push on determines much of the acceleration of the projectile. The mass of the compressed gas behind the projectile both depends on the valve and transfer port of the air gun (and in turn, may affect the action of the valve and transfer port), and changes temperature as the compressed gas expands (expanding gases absorb heat: get cold, resulting in a temperature drop). The transfer port discharge of compressed gas becomes critical when the projectile has traveled a certain distance down the barrel 602 of the air gun. The pressure peak in an air gun barrel 602 is reached early in the travel of the projectile because of the pressure-relieving effect of the projectile movement (creating more volume for the gas in the barrel 602).

Figure 11:
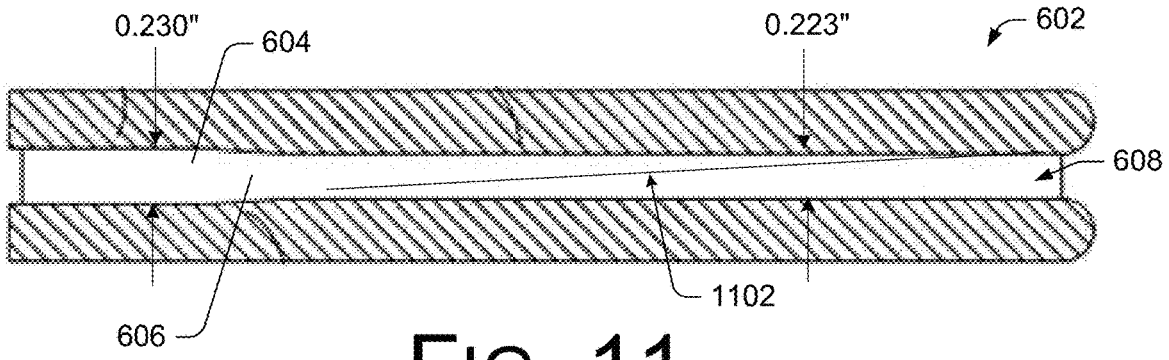
FIG. 11 shows a cross-section of a portion of an example .22 caliber air gun chamber and barrel, according to an embodiment.
Figure 12:
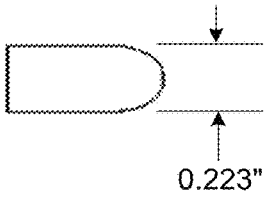
FIG. 12 shows a side view of an example .22 caliber bullet.
Figure 13:
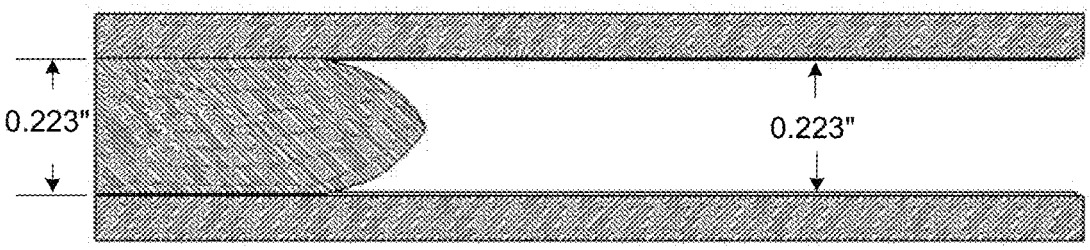
FIG. 13 shows a cross-sectional diagram of a chambered bullet in an example .22 caliber air gun, according to an embodiment.

Referring to FIGS. 11-13, novel air gun 100 properties are disclosed and described. FIG. 11 shows a cross-section of a portion of an example .22 caliber air gun 100 barrel 602, including the novel chamber 604, throat 606, and bore 608. FIG. 12 shows the dimensions of a typical .22 bullet 302, and FIG. 13 shows a detail view of the bullet 302 within the throat 606 or the bore 608. Referring to FIGS. 11, 12, and 13, the dimensions of the bullet 302 (at FIG. 12) can be compared to the dimensions of the chamber 604, throat 606, and bore 608 (at FIGS. 11 and 13). While .22 caliber dimensions are shown, the discussion is also relevant to air guns 100 of other calibers and their respective ammunition, with their associated dimensions.

The chamber 604 is the first portion of the barrel 602, and it has an interior diameter (e.g., 0.230") that is sized larger than the outer diameter of the bullet 302 for easy loading of the bullet 302. The throat 606 is the section of the barrel 602 that accommodates the bullet 302 prior to expelling, and can have an interior dimension that tapers from the inner dimension of the chamber 604 to the inner dimension of the bore 608, which is the outer dimension of the bullet 302 (e.g., 0.223"). The bore 608 is the travel path for the bullet 302 down the length of the barrel 602, and includes a novel sectional rifling for torque induced procession of the bullet 302, without the use of lands (and avoiding their associated drag surfaces). The sectional rifling includes a quantity of creases 1102 that are disposed down the length of the interior surface of barrel 602 in a helical arrangement, in order to induce a spin on the bullet 302 as it travels down the length of the barrel 602. The creases 1102 can extend from the interior surface of the barrel 602 approximately 0.00025" to 0.0005", making the bore 608 approximately equal to the outer dimension of the bullet 302 (e.g., 0.223").

Referring to the detail of FIG. 13, in some implementations, the throat 606 may not include a leade 804 or tapered section. In these implementations, the throat 606 may comprise a section with a constant interior diameter. In other implementations, the throat 606 may be omitted. In those implementations, the bore 608 contacts the chamber 604 directly. In either case, with the bore 608 having the same interior diameter as the outer dimension of the bullet 302, the bullet 302 is self-aligning when inserted into the bore 608.

During a triggering event, the force of the compressed gas (e.g., about 3500 to 4000 psi in some examples) pushes the bullet 302 into the bore 608 without deforming the bullet 302. (The air gun 100 does not have the energy to deform the bullet 302, and cannot compress or expand the bullet 302.) Since the bullet 302 has the same dimension as the bore 608, much less pressure is required to shoot the bullet 302 down the bore 608. In the process, the creases 1102 guide the surface of the bullet 302 as the bullet is propelled down the bore 608, inducing a spin on the bullet 302. Consequently, the surface contact between the bullet 302 and the bore 608 is reduced, as well as the associated friction.

Figure 14:
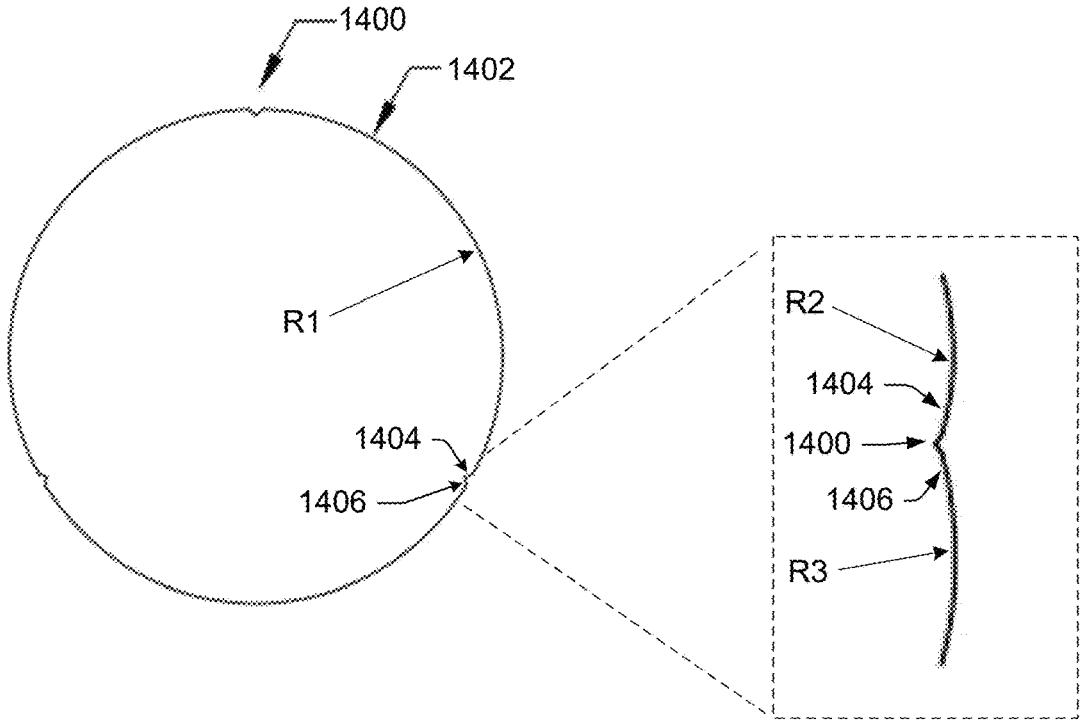
FIG. 14 shows an end view and a close up view of a novel rifling pattern for an air gun, according to an embodiment.
Figure 15:
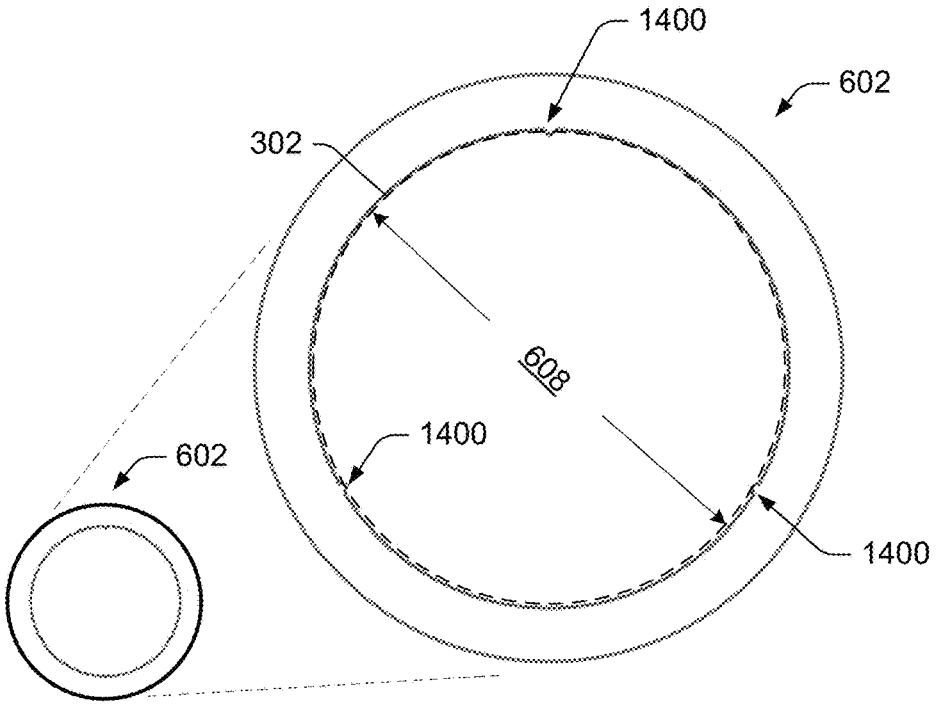
FIG. 15 shows an end view of the novel rifling pattern for an air gun, according to an embodiment.

FIGS. 14 and 15 show end views of the barrel 602 of the air gun 100, and include example section views of the creases 1102 of the rifling. In section-view, the creases 1102 appear as nodes 1400. The shape of each crease 1102 or node 1400 is generally consistent and is arranged in a rotation around the perimeter of the bore 608 over the length of the barrel 602, in a helix or screw arrangement. In an example, anode 1400 can make a full revolution around the perimeter of the barrel 602 with about 12 inches of travel down the length of the barrel 602. In other examples, the rate may be greater or lesser. The rate of rotation per length of barrel 602 (e.g., pitch) determines the speed of the spin on the bullet 302. In one example, the spin of the bullet 302 when shot from the air gun 100 is about ⅓ the revolutions per minute of the spin of the same bullet 302 when fired from a firearm.

The goal of the novel sectional rifling is to induce a spin on the bullet 302 without losing any of the limited gas pressure available. The bore 608 can be well-sealed by the bullet 302 (to reduce blow-by) since the diameter of the bullet 302 matches the interior diameter of the bore 608. A further goal is to reduce drag on the bullet 302, to make the most efficient use of the available energy of the air gun 100. This is accomplished since the creases 1102 do not include the drag surfaces of traditional lands 610 due to their unique profile shape.

In an implementation, the nodes 1400 (and thus the creases 1102) are formed of a pair of converging arc segments, which is shown at FIGS. 14-17. Thus, instead of lands and grooves, the sectional rifling is comprised of a repeating set of three distinct arcs. The remainder of the bore 608 is comprised of large arc segments 1402 with a radius R1, while the nodes 1400 (or the creases 1102, in three dimensions) are formed of the convergence of much smaller arc segments 1406 and 1406 with a radius of R2 and R3, respectively. In some embodiments, the radiuses R2 and R3 are equal, and in other embodiments, they may be of different values. In an implementation, the radius values R2 and R3 are less than the radius value R1, which is equal to or less than the radius value of the barrel 602.

FIG. 15 also shows an overlay of an example bullet 302 as it sits in the bore 608 while it moves down the barrel 602. The outer diameter of the bullet 302 fits within the bore 608, without the creases 1102 biting into the bullet 302. As mentioned, the height of the nodes 1400 can be between 0.0005" and 0.00025". The creases 1102 in the bore 608 guide and spin the bullet 302 without the use of lands or like formations that engrave the bullet 302 and/or induce drag.

Figure 16:
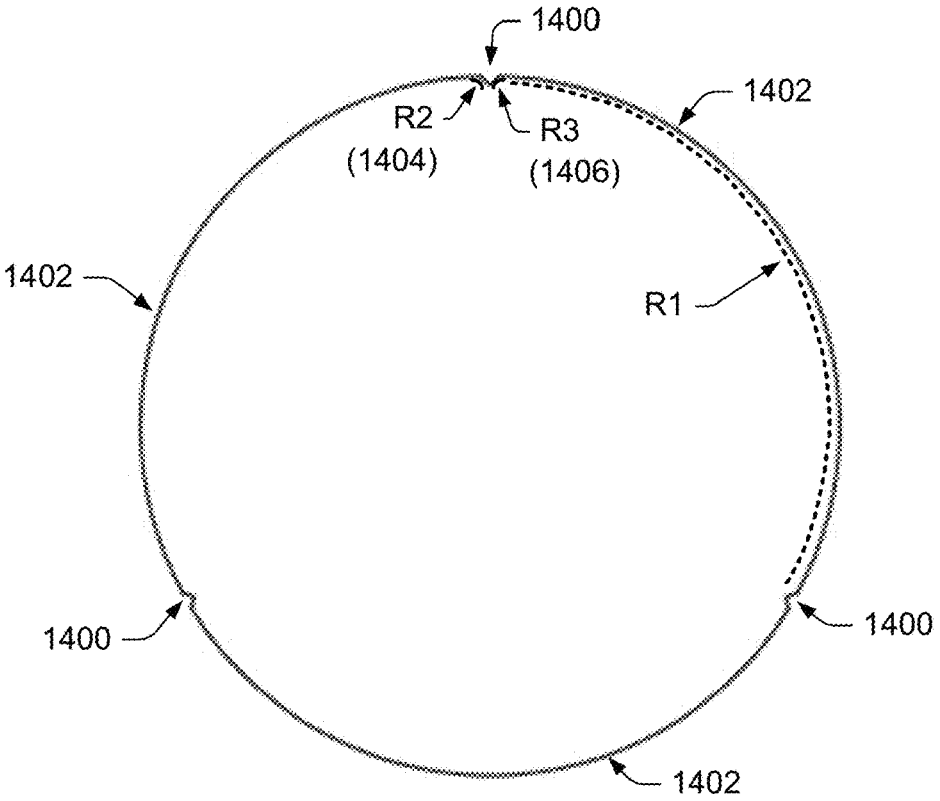
FIG. 16 shows arc segments comprising the end view of the novel rifling pattern for an air gun of FIGS. 14 and 15, according to an embodiment.
Figure 17:
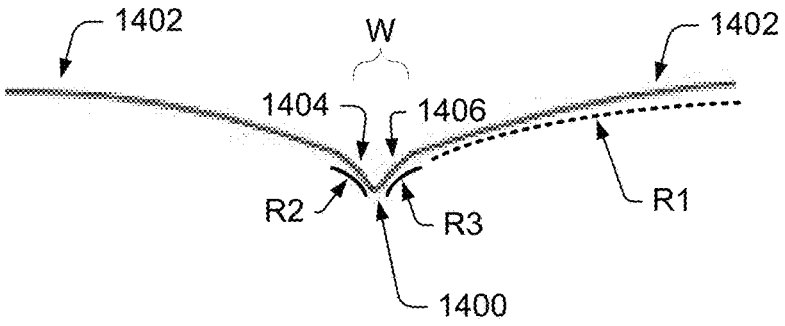
FIG. 17 shows a close up detail of the arc segments comprising the end view of the novel rifling pattern for an air gun of FIGS. 14 and 15, according to an embodiment.

The structure of the nodes 1400 (and thus the creases 1102) is shown in greater detail at FIGS. 16 and 17. As shown, the novel sectional rifling is comprised of a repeating set of the three distinct arcs: 1402, 1404, and 1406, each coupled end-to-end and oriented in a convex-outward arrangement. In other words, the convex face of each arc (1402, 1404, and 1406) faces outward toward the barrel 602 rather than inward toward the bore 608. Thus, the structure of the nodes 1400 is the result, effect, or residual of the process used to form the bore 608. In other embodiments, other arrangements of the three arcs can be possible (e.g., one of the arc segments 1404 and 1406 may be oriented convex-inward).

The number of nodes 1400 is variable. In some examples, a sectional rifling may include 3 to 5 nodes 1400. In other examples, more nodes 1400 may be present. In any case, the ratio of node 1400 width (shown as "W" in FIG. 17) to the arc length of arc 1402 can be 1:50 or higher. In alternate examples, the ratio of node 1400 width to the arc length of arc 1402 may be lower than 1:50. The node width "W" is defined as the distance from an intersection of one arc 1402 with an arc segment 1404 to the intersection of the rightmost next arc 1402 with an arc segment 1406, wherein the arc segments 1404 and 1406 of interest also converge. As mentioned, it is that convergence of arc segments 1404 and 1406 that forms the node 1400, and it is this node 1400 shape (i.e., the vertex of the converging arc segments 1404 and 1406) that reduces drag on the bullet 302, particularly as compared to lands 610 and grooves 612.

Accordingly, the bullet 302 is not deformed or engraved or etched as it is pushed onto the rifling by the compressed gases, since no lands are used. Further, no material is removed from the bullet 302 since there is no engraving of the bullet 302. This also helps to prevent material from being deposited in the rifling or onto the bore 608. This can relieve the need for frequent cleaning of the barrel 602, depending on the material of the bullet 302.

Example novel sectional barrel rifling schemes reduce wear on the air gun barrel 602 and allow a conventional metal jacket bullet 302 to attain the velocity and spin needed for the metal jacket bullet to be practical in an air gun 100. The described sectional rifling for air guns 100 creates a good bullet-to-barrel fit around conventional metal jacket bullets 302, creating a good gas seal around the metal-jacket bullet 302 for consistent and increased muzzle velocity and better accuracy. In some implementation, the muzzle velocity can be 500 ft./sec. and greater, and often as much as 1000 ft./sec. The improved gas seal of the sectional rifling also conserves the supply reservoir ("tank") of high-pressure gas propellant.

A metal bullet jacket typically enables higher muzzle velocity than bare lead, for example, or bullets with surfaces containing iron, without depositing traces of metal in the bore 608 of the air gun 100. The metal jackets also prevent damage to bores 608 that can occur when the outer surface of the bullet 302 is composed of hard steel or an armor-piercing material. In various embodiments, the jacket of the metal-jacketed bullets 302 is comprised of a copper or a copper alloy. In other embodiments, the bullet jacket is comprised of another metal, another metal alloy, or a composite of metal and other materials. In some cases, the bullets 302 are comprised of a solid metal or a solid metal alloy, with or without a metal jacket.

Since the sectional rifling (i.e., the creases 1102) spirals down the length of the barrel 602, the rifling induces a spin on the bullet 302 along a central longitudinal axis of the bullet 302 when the bullet 302 travels the length of the barrel 602. The spin can give stability to the bullet 302 during its flight, due to the gyroscopic effect of the spin. The self-aligning characteristic of the throat 606 (when present) and the bore 608 centers the bullet 302 when it is loaded into the bore 608 and when it travels down the bore 608. This has the effect of reducing or eliminating wobble, resulting in a more stable flight. Further, since the creases 1102 do not remove material from the bullet 302, the bullet 302 has a much greater opportunity to spin on a center of gravity that comprises the central longitudinal axis of the bullet 302. The result is improved accuracy and flight range.

Referring to FIGS. 16 and 17, the nodes 1400 (i.e., creases 1102) guide the bullet 302 to induce the spin on the bullet 302. The shape of the nodes 1400 reduces or eliminates potential drag surfaces. The result is a drop in friction within the bore 608, which translates to improved bullet 302 velocities, no added heat in the barrel 602, and less wear to the bore 608, as well as no removed material from the bullet 302. In each case, the efficiency of the shot is improved and the wear on the air gun is decreased.

Various gain-twist or progressive rifling schemes may be incorporated into the barrel 602 of the air gun 100 for adapting metal-jacket bullets 302 to air gun use, in combination with the sectional rifling described above. These example gain-twist schemes for adapting metal jacket bullets 302 to air gun use include imparting the least friction and spin to the metal-jacket bullet 302 at the beginning of its travel, (over the first 10-12 inches, for example) when the pressure propelling the metal jacket bullet 302 is at its highest and as the metal jacket bullet 302 is gaining momentum.

In another implementation, the rifling twist of the sectional rifling increases proportionately according to a linear function as the bullet 302 travels down the barrel 602, to preserve momentum of the bullet 302 by not imparting rifling spin too early, considering the pressures at play in an air gun, and to conserve the tank reservoir of compressed air while giving maximum velocity and accuracy to the bullet 302 being propelled. For instance, gain-twist in an example air gun 100 may start out at some nominal twist-rate (x-revolutions per y-distance) and slowly increase the rate of twist, so that the twist at the muzzle-end may be as much as 2 times the starting twist, thus increasing the radial spin and the number of revolutions made by the projectile during flight.

The gain-twist sectional rifling may also be configured to spread torque evenly along the operating length of the barrel, rather than applying too much stress on any one portion of the barrel. Too much stress can happen at the breech end of the barrel with continuous-twist rifling that is too aggressive and engages the bullet too firmly at the start of the bullet's acceleration in an air gun described herein. In yet another implementation, the rifling twist of the sectional rifling increases according to a logarithmic function, or the like, as the bullet 302 travels down the barrel 602.

In some embodiments, an added lubricant or lubricating coating (e.g., Teflon, etc.) may be disposed on the interior surface of the barrel 602, including on the creases 1102 of the sectional rifling. The lubricant may be integral to the material of the barrel 602, or may be infused or impregnated into the material of the barrel 602 as well. In an implementation, a lubricant is stabilized in a porous or textured barrel material by capillary forces, forming a lubricant-impregnated interface between barrel 602 material and the metal jacket bullet 302. The use of the lubricant or lubricating coating or material is possible (and can be maintained) since there is little to no heat associated with shooting conventional bullets 302 through the air gun 100.

The example air gun barrels 602 and the special sectional rifling can be made by conventional button rifling, cut rifling, swaging, hammer forging, laser, etching, and twisting, for example. Additionally, the lack of exposure to high temperatures allows the barrel 602 to be made of a variety of materials. The example air gun barrels 602 described herein are not generally susceptible to requirements of being able to withstand high pressure and heat associated with gunpowder detonation in conventional firearms. In some embodiments, the barrel 602 may be comprised of tool steel, ferrous and nonferrous materials, or the like. In other embodiments, the barrel 602 may be comprised of brass, hydraulic tubing, or other lighter metals.

Brass alloys can also be used for example air gun barrels 602. Brass is easy to work with and has good qualities for example air gun barrel 602. Brass is easy to machine and easy to rifle. Brass particulates break away cleanly leaving a good surface, and brass provides rust resistance and does not corrode. However, brass is heavier than steel and not as strong as steel but strong enough for air gun pressures in operable thicknesses.

Barrel steel can include 4130/4140 chromium-molybdenum variety ("chrome-moly"), which can resist the wear of metal jacketed bullets 302. The addition of the alloy elements chromium, for wear, and molybdenum for toughness and strength make this alloy a good choice for longevity, but the metal can be difficult to machine. A chrome-moly barrel 602 can be used for very high-pressure air guns made possible by the inventions described herein. Otherwise chrome-moly may be overkill for lesser air gun pressures.

Stainless steel air gun barrels 602 provide corrosion and rust resistance and the main alloy constituent in this stainless steel is chromium. Chromium improves wear resistance in light of metal-jacket bullets. A variety of 1117 steel can be used, since the example air guns 100 described herein have to resist at least copper-plated metal jacket bullets 302. This steel is hard enough and machines freely. The chips break away cleanly resulting in a smooth surface. This is advantageous because the example air gun barrels 602 can be made out of solid bar stock and the bore 608 is drilled completely through the block. The drilled barrel 602 is then reamed to size before cutting the rifling. The 1117 steel polishes readily and can be hot, salt-bath blued as performed routinely for firearms.

Tubing can be machined into air gun barrels 602 in some implementations described herein, such as a low carbon 1020 tube. Cold, drawn seamless tubing can be employed, or welded tubing drawn over a mandrel. However, tubing can be difficult to machine.

In further embodiments, the barrel 602 may be comprised of ceramics, thermoset plastics, polymer composites, carbon fiber, graphene materials, or other emerging technology materials and composites. Wrapping and related methods for stiffing and stabilizing can be used. The use of some of these materials can decrease the friction within the bore 608, as well as lighten the weight of the air gun 100. Also, the use of some of these materials can make manufacturing the barrel 602 easier and/or less expensive.

Example chambers, barrel rifling, surface technology and other features for air guns described herein not only allow air guns to use metal jacket bullets, but also reduce wear and tear on the modified air gun barrel. More importantly the novel features described herein enable the example air guns to achieve higher muzzle velocities than conventional air guns, better bullet flight, and higher accuracy than conventional air guns, while using standard metal-jacket bullets made for firearms.

Representative Process

Figure 18:
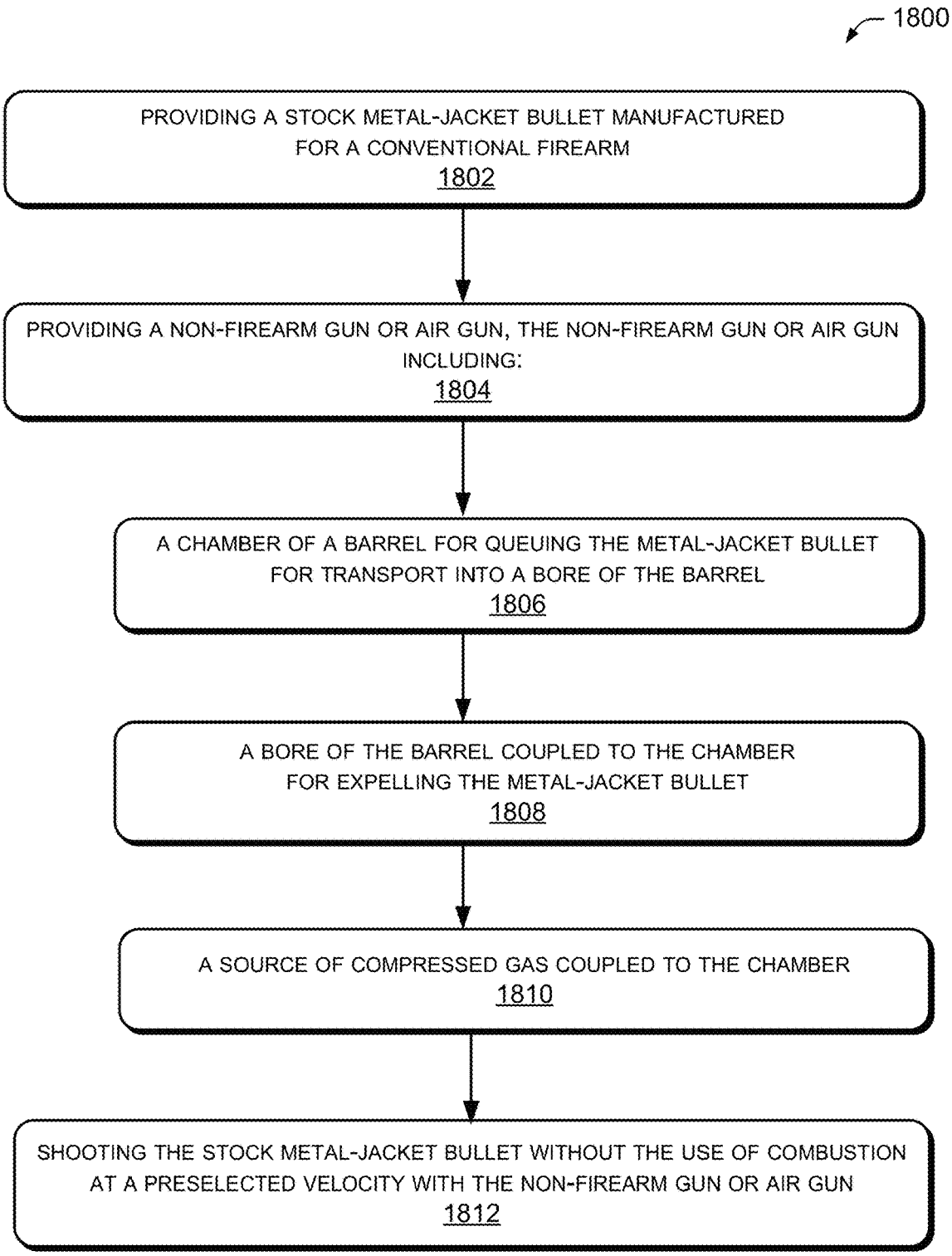
FIG. 18 is a flow chart for a method of propelling a metal jacket bullet from an air gun, according to an embodiment.

FIG. 18 illustrates a representative process 1800 for implementing techniques and/or devices relative to propelling a metal jacket bullet (such as a bullet 302, for example) from an air gun (such as air gun 100, for example), according to various embodiments. The example process 1800 is described with reference to FIGS. 1-17.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable hardware, software, firmware, or a combination thereof, without departing from the scope of the subject matter described herein.

At block 1802, the process includes providing a stock metal jacket bullet manufactured for a conventional firearm (such as the bullet 302, for example).

At block 1804, the process includes providing a non-firearm gun or air gun (such as air gun 100, for example), the non-firearm gun or air gun including: a chamber (such as chamber 604, for example) of a barrel (such as barrel 602, for example) for queuing the metal-jacket bullet for transport into a bore of the barrel (block 1806), a bore (such as bore 608, for example) of the barrel coupled to the chamber for expelling the metal jacket bullet (block 1808), and a source of compressed gas coupled to the chamber (block 1810).

At block 1812, the process includes shooting the stock metal-jacket bullet without the use of combustion at a preselected velocity (such as 500 ft./sec. or greater) with the non-firearm gun or air gun. In an implementation, the mass of the metal jacket bullet is at least 55 grains.

In an implementation, the process includes providing a sectional rifling without lands disposed within the bore and configured to impart a spin on the metal jacket bullet when the metal jacket bullet traverses a length of the bore. In various embodiments, the sectional rifling is comprised of a plurality of creases disposed in a helical arrangement along a length of the bore. A cross-sectional profile of a crease of the plurality of creases comprises a pair of arc segments oriented in a convex-outward arrangement, wherein a convex face of each arc segment faces outward toward the barrel and away from the bore, the arc segments converging to a vertex node at a peak of the crease.

Alternately, a cross-sectional profile of a crease of the plurality of creases comprises a pair of arc segments, one of the arc segments oriented in a convex-outward arrangement, wherein a convex face of the arc segment faces outward toward the barrel and away from the bore and the other arc segment oriented in a convex-inward arrangement, wherein a convex face of the other arc segment faces inward toward the bore and away from the barrel, the arc segments converging to a vertex node at a peak of the crease.

In an implementation, a ratio of a length of a section of the bore bounded by two creases to a width of a crease of the plurality of creases is higher than 50:1.

In an implementation, a cross-sectional profile of the sectional rifling is comprised of a plurality of sets (such as 3-5 sets, for example) of three intersecting arc segments.

In an implementation, the process includes not removing material from the metal-jacket bullet by the sectional rifling while the metal jacket bullet traverses the length of the bore. Alternately, the process includes not deforming or engraving the metal jacket bullet by the sectional rifling while the metal jacket bullet traverses the length of the bore.

In an implementation, the barrel is comprised of a polymer or a composite including a polymer. Alternately, the barrel is comprised of various metals or metal alloys. In one implementation, an infused lubricant, a polymer coating, or a friction reducing film is disposed at a surface of the bore.

In alternate implementations, other techniques may be included in the process in various combinations, and remain within the scope of the disclosure.

Various modifications and changes can be made to the embodiments presented herein without departing from the broader spirit and scope of the disclosure. For example, features or aspects of any of the embodiments can be applied in combination with any other of the embodiments or in place of counterpart features or aspects thereof. Accordingly, the specification and drawings are to be regarded in an illustrative rather than a restrictive sense.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the disclosure.

Although various implementations and examples are discussed herein, further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. An apparatus, comprising:

a non-firearm gun or air gun configured to shoot a metal-jacket bullet without the use of combustion at a preselected velocity, the metal-jacket bullet manufactured for a conventional firearm, the non-firearm gun or air gun including:

a chamber of a barrel for queuing the metal jacket bullet for transport into a bore of the barrel;

a bore of the barrel coupled to the chamber for expelling the metal jacket bullet at the preselected velocity;

a sectional rifling disposed within the bore of the barrel, comprising a plurality of creases disposed in a helical arrangement along a length of the bore, wherein a cross-sectional profile of the sectional rifling is comprised of a plurality of sets of intersecting arc segments, with each set of intersecting arc segments including a node comprised of two of the arc segments converging to form the node coupled to a larger single arc segment at one side of the node, wherein a ratio of a length of the larger single arc compared to a width of the node is greater than 30:1; and a source of compressed gas coupled to the chamber.

2. The apparatus of claim 1, wherein the sectional rifling is configured to impart a spin on the metal-jacket bullet when the metal-jacket bullet traverses a length of the bore.

3. The apparatus of claim 1, wherein a cross-sectional profile of a crease of the plurality of creases comprises the two of the arc segments oriented in a convex-outward arrangement, wherein a convex face of each of the two arc segments faces outward toward the barrel and away from the bore, the two of the arc segments converging to a vertex of the node at a peak of the crease.

4. The apparatus of claim 1, wherein a ratio of a length of a section of the bore bounded by two creases to a width of a crease of the plurality of creases is higher than 50:1.

5. The apparatus of claim 1, wherein the cross-sectional profile of the sectional rifling is comprised of a plurality of sets of three intersecting arc segments.

6. The apparatus of claim 5, wherein the cross-sectional profile of the sectional rifling is comprised of 3 to 5 sets of three intersecting arc segments.

7. The apparatus of claim 5, wherein the three intersecting arc segments are oriented in a convex-outward arrangement, wherein a convex face of each arc segment faces outward toward the barrel and away from the bore.

8. The apparatus of claim 2, wherein the metal jacket bullet is not deformed or engraved by the sectional rifling as the metal jacket bullet traverses the length of the bore.

9. The apparatus of claim 1, wherein the preselected velocity comprises at least 500 feet per second and the mass of the metal jacket bullet is at least 55 grains.

10. The apparatus of claim 1, further comprising a throat of the air gun connecting the chamber and the bore, the throat having a constant profile diameter equal to a diameter of the bore.

11. The apparatus of claim 1, wherein the barrel is comprised of a polymer or a composite including a polymer.

12. An apparatus, comprising:

a non-firearm gun or air gun configured to shoot a metal-jacket bullet without the use of combustion at a velocity of at least 500 feet per second, the metal jacket bullet having a caliber of at least .22 and manufactured for a conventional firearm, the non-firearm gun or air gun including:

a chamber of a barrel for queuing the metal jacket bullet for transport into a bore of the barrel;

a bore of the barrel coupled to the chamber for expelling the metal jacket bullet at the preselected velocity, the bore having an inside diameter equal to the outside diameter of the metal-jacket bullet;

a sectional rifling without lands disposed within the bore and configured to impart a spin on the metal-jacket bullet when the metal-jacket bullet traverses a length of the bore, the sectional rifling comprising a plurality of creases disposed in a helical arrangement along a length of the bore, wherein a cross-sectional profile of the sectional rifling is comprised of a plurality of sets of three intersecting arc segments, with each set of three intersecting arc segments including a node comprised of a pair of converging arcs coupled to a larger single arc at one side of the node, wherein a ratio of a length of the larger single arc compared to a width of the node is greater than 30:1; and a source of compressed gas coupled to the chamber.

13. The apparatus of claim 12, further comprising an infused lubricant, a polymer coating, or a friction reducing film disposed at a surface of the bore.

14. The apparatus of claim 12, wherein the ratio of the length of the larger single arc compared to the width of the node is equal to or greater than 50:1.

15. The apparatus of claim 12, wherein a radius of each of the pair of converging arcs is less than a radius of the larger single arc.

16. A method, comprising:

providing a metal-jacket bullet manufactured for a conventional firearm;

providing a non-firearm gun or air gun, the non-firearm gun or air gun including:

a chamber of a barrel for queuing the metal jacket bullet for transport into a bore of the barrel;

a bore of the barrel coupled to the chamber for expelling the metal jacket bullet;

a sectional rifling disposed within the bore of the barrel, comprising a plurality of creases disposed in a helical arrangement along a length of the bore, wherein a cross-sectional profile of the sectional rifling is comprised of a plurality of sets of intersecting arc segments, with each set of intersecting arc segments including a node comprised of two of the arc segments converging to form the node coupled to a larger single arc segment at one side of the node, wherein a ratio of a length of the larger single arc compared to a width of the node is greater than 30:1; and a source of compressed gas coupled to the chamber; and shooting the metal-jacket bullet without the use of combustion at a preselected velocity with the non-firearm gun or air gun.

17. The method of claim 16, further comprising providing that the sectional rifling is without lands and is configured to impart a spin on the metal-jacket bullet when the metal-jacket bullet traverses a length of the bore.

18. The method of claim 17, further comprising not removing material from the metal-jacket bullet by the sectional rifling while the metal-jacket bullet traverses the length of the bore.

* * * * *